US005105775A

United States Patent [19]

Maissant

[11] Patent Number: 5,105,775

[45] Date of Patent: Apr. 21, 1992

[54] TWO-STROKE ENGINE WITH CONTROLLED PNEUMATIC INJECTION

[75] Inventor: Jean-Pierre Maissant, Rueil Malmaison, France

[73] Assignee: Institut Francais du Petrole, Rueil Malmaison, France

[21] Appl. No.: 635,995

[22] Filed: Dec. 31, 1990

[30] Foreign Application Priority Data

Dec. 29, 1989 [FR] France ..... 89 17483
Dec. 29, 1989 [FR] France ..... 89 17484

[51] Int. Cl.[5] ..... F01L 1/02; F02B 77/00; F02B 33/04; F02B 75/02

[52] U.S. Cl. ..... 123/70 R; 123/73 V; 123/73 PP

[58] Field of Search ..... 123/70 R, 70 V, 65 B, 123/73 V, 73 DA, 73 PP, 73 A, 73 C, 74 D, 73 B

[56] References Cited

U.S. PATENT DOCUMENTS 4,362,132 12/1982 Neuman ..... 123/73 V
4,781,155 11/1988 Brucker ..... 123/70 V
4,813,387 3/1989 Prevedel et al. ..... 123/74 D
4,917,073 4/1990 Duret ..... 123/73 C
4,944,255 7/1990 Duret ..... 123/73 C
5,033,418 7/1991 Maissant et al. ..... 123/70 V

FOREIGN PATENT DOCUMENTS 1190251 4/1965 Fed. Rep. of Germany .
1165071 5/1958 France .
2496757 6/1982 France .
0296969 12/1988 France .

*Primary Examiner*—E. Rollins Cross
*Assistant Examiner*—M. Macy
*Attorney, Agent, or Firm*—Antonelli, Terry, Stout & Kraus

[57] ABSTRACT

A two-stroke engine with controlled pneumatic injection is disclosed, wherein at least one connecting duct joins the combustion chamber of a first cylinder to the crankcase-pump of a second cylinder. The means for controlling the injection of carburetted air into the chamber of the first cylinder comprise at least one flange fixed rigidly to the shaft of the crankcase of the engine inside the crankcase-pump of the second cylinder. The flange comprises a recess on its peripheral portion so as to be able to isolate the crankcase-pump from or place it in communication with the inner volume of the combustion chamber at given times of the engine cycle.

10 Claims, 11 Drawing Sheets

TWO-STROKE ENGINE WITH CONTROLLED PNEUMATIC INJECTION

BACKGROUND OF THE INVENTION

The invention relates to a two-stroke engine with controlled pneumatic injection.

Multi-cylinder two-stroke engines generally comprise, associated with each of the cylinders, a housing called "crankcase-pump" communicating with one of the ends of the combustion chamber of the cylinder and feeding fresh gases into the cylinder, via at least one duct and a transfer opening. The piston which reciprocates in the cylinder also provides suction and compression of the fresh gases in the crankcase-pump. An intake valve disposed on the crankcase-pump allows fresh gases to be fed into the crankcase when the piston moves in the direction opposite the crankcase, the fresh gases then being compressed and causing closure of the valve, when the piston moves towards the crankcase. When the corresponding openings of the cylinder are freed by the piston, fresh gases are fed into the cylinder through the transfer ducts and openings and cause sweeping with fresh gases for replacing the burnt gases which are discharged through exhaust openings generally disposed in staggered fashion with respect to the transfer openings. The piston moves away from the crankcase so as to compress the gases contained in the cylinder. The ignition and combustion of the air and fuel mixture then produce the drive stroke of the piston towards the crankcase.

In the case of a multi-cylinder engine, pneumatic fuel injection into a first cylinder is provided by using the pressure of the fresh gases inside the crankcase-pump of a second cylinder whose piston moves with an angular shift with respect to the piston of the first cylinder, considering the rotation of the crankshaft passing in the axial direction through the assembly of crankcase-pumps of the engine.

Generally, the pressurized air used for injection in a cylinder comes from the crankcase-pump of a second cylinder whose delay, in so far as the rotation of the crankshaft is concerned, may be 120°, in the case of an engine with three, six, . . . three n cylinders or else 90° in the case of an engine with four, eight, . . . four n cylinders with respect to the cylinder in which the injection takes place.

Devices have also been proposed for controlling the injection of the carburetted mixture and in particular devices for controlling the beginning of introduction of this carburetted mixture at the end of scavenging of the cylinder of the engine with fresh air.

These devices may be formed by an automatic valve, a controlled valve, a rotary valve or else by an opening formed in the second cylinder from which the injection takes place, cooperating with the skirt of the corresponding piston.

Generally, no control or check of the injection takes place directly at the output of the crankcase-pump, at the level of an opening in this crankcase-pump to which the duct for connection to the first cylinder is connected.

SUMMARY OF THE INVENTION

The invention provides then a two-stroke engine comprising at least a first cylinder in which a piston moves and a second cylinder one of the ends of which communicates with a crankcase-pump through which the crankshaft of the engine passes in an axial direction, comprising a means for air intake into the crankcase-pump, at least one connection duct between the crankcase-pump of the second cylinder and the combustion chamber of the first cylinder, means for feeding at least one of the connection ducts with fuel, injection control means for isolating the crankcase-pump of the second cylinder from or putting it in communication with the combustion chamber of the first cylinder and connection means between the movable pistons in the first and second cylinders connected to the crankshafts, so that an angular shift is provided between the cycles of the first and second cylinders, this engine comprising injection control means, at the level of the crankcase-pump of the second cylinder providing an injection which is perfectly regulated with respect to the operating cycle of the engine.

For this, the injection control means comprise at least one substantially cylindrical flange rigidly fixed on the shaft of the crankshaft, inside the crankcase-pump of the second cylinder and having at least one recess in its peripheral portion so as to provide isolation and/or communication between the combustion chamber of the first cylinder and the crankcase-pump of the second cylinder at predetermined times of the operating cycle of the engine under the effect of the rotation of the crankshaft.

Without departing from the scope of the invention, the injection control means further comprise an automatic assisted valve whose shank is connected to a flexible membrane sealingly separating two chambers, at least one of which being connected by a duct to a closable opening communicating with the inner volume of one of the crankcase-pumps of the first or second cylinders.

BRIEF DESCRIPTION OF THE DRAWINGS

For better understanding of the invention, several embodiments of a two-stroke engine according to the invention will now be described by way of non limiting examples with reference to the accompanying drawings in which.

DESCRIPTION OF THE PREFERRED EMBODIMENTS

Figure 1:
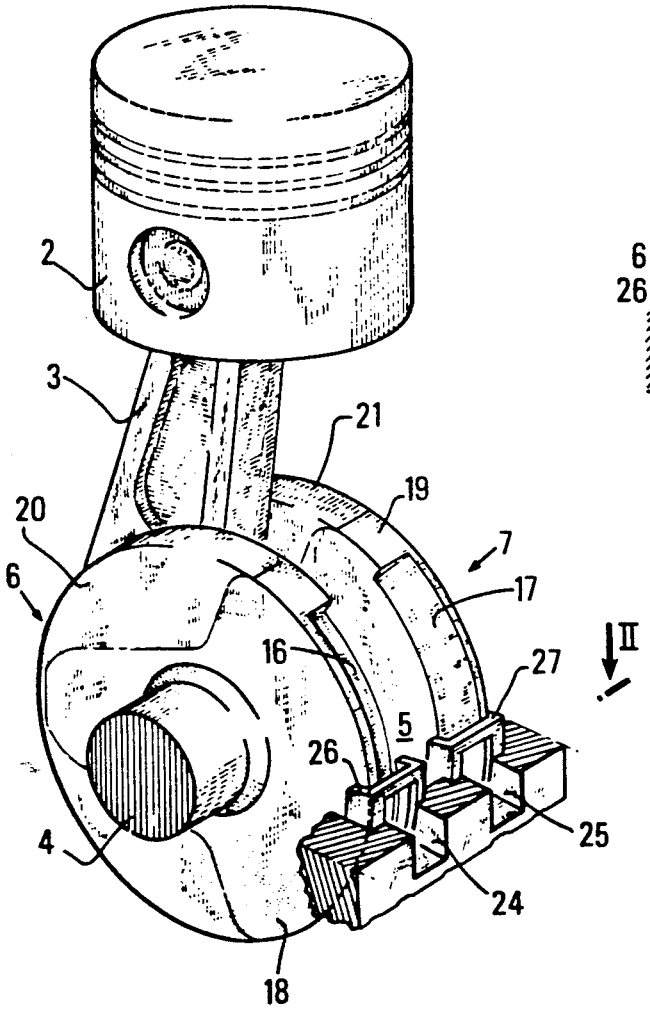
FIG. 1 is an exploded perspective view of the crankcase-pump of a cylinder of an engine according to the invention and of the corresponding piston.

In FIG. 1, a part of the wall of the casing 1 of a cylinder of an engine according to the invention can be seen comprising, at its upper part, the combustion chamber of the cylinder in which the piston 2 moves connected by an articulated connecting rod 3 to the crankshaft 4 of the engine passing in an axial direction through a lower chamber 5 defined in the lower part of casing 1 and by two lateral flanges 6 and 7. Chamber 5 forming the crankcase-pump associated with the cylinder communicates with the lower part of the combustion chamber of the cylinder.

Referring to any one of FIGS. 3 to 6, it can be seen that the casing 1 of the first cylinder shown on the eft of the Figure or casing 1' of the second cylinder shown on the right of the Figure form, in their upper part, the chamber of the cylinder in which a piston 2 (or 2') moves and, in their lower part, the crankcase-pump 5 (or 5') into which the lower part of the cylinder opens.

The crankcase-pump 5 (or 5') comprises an air intake opening or nozzle 9 in which is inserted a valve 10 allowing atmospheric air to enter the crankcase-pump 5 when the latter is under depression. Nozzle 9 is fixed to the wall of casing 1 at the level of the crankcase-pump, between flanges 6 and 7.

Figure 3:
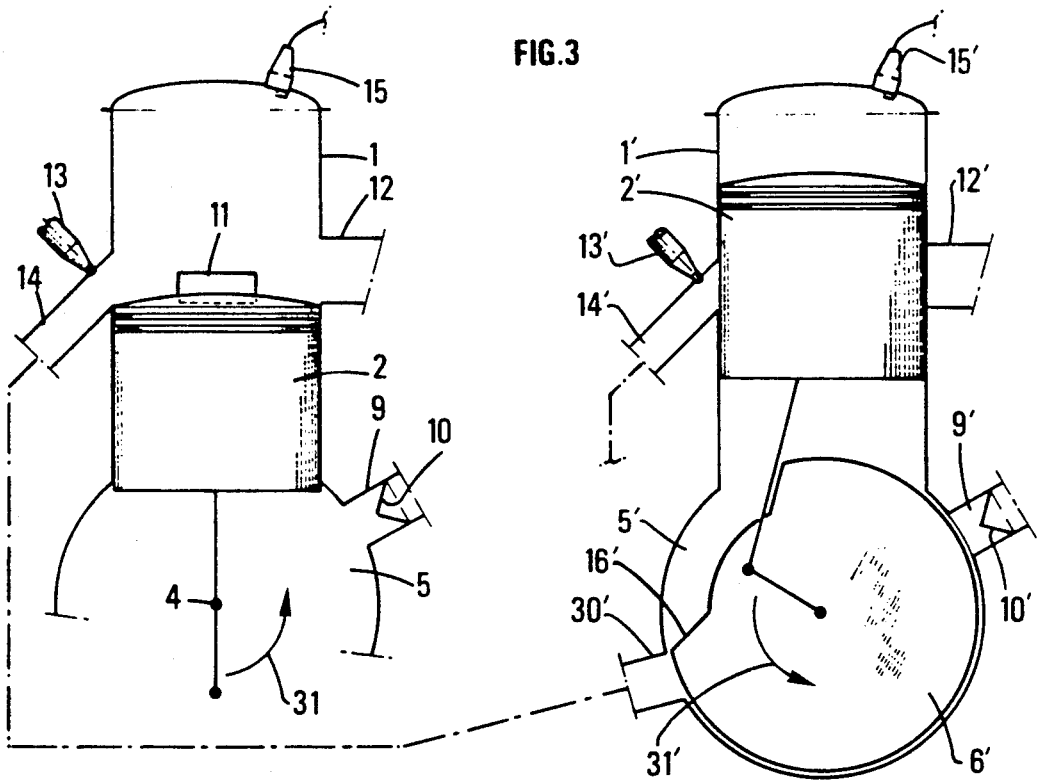
FIGS. 3, 4, 5 and 6 are schematic views of cylinders of a two-stroke engine according to the invention and in a first embodiment, during four successive phases of the operating cycle of the engine.

Atmospheric air is likely sucked inside the crankcase-pump when piston 2 moves upwards and is compressed inside the crankcase-pump 5 when the piston moves to reach its bottom position such as shown in the left hand part of FIG. 3, for example.

The crankcase-pump of each of the cylinders communicates via at least one external duct and an opening such as 11 with the chamber of the cylinder. A discharge duct 12 discharges the burnt gases before they are replaced by fresh air coming from the crankcase-pump 5.

In the case of a pneumatic injection engine, the combustion chamber of the cylinder in which piston 2 moves is connected to a pressurized air injection duct 14 into which a fuel injector 13 emerges.

The pressurized air and fuel mixture is injected at a given time inside the cylinder, mixed with fresh air introduce into the cylinder then compressed, as shown in the right-hand part of FIG. 3. A sparking plug 15 fixed in the cylinder head which is fixed to casing 1 at its upper part provides ignition and combustion of the mixture which causes the piston to move down towards the crankcase-pump.

Figure 2:
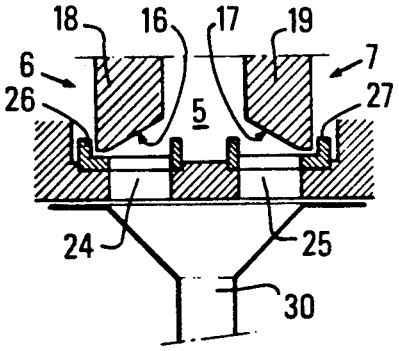
FIG. 2 is a sectional view through II of FIG. 1.

According to the invention as it is shown in FIGS. 1 and 2, flanges 6 and 7 comprise recesses or cut-outs respectively 16 and 17 of bevelled form, on a part of the periphery of the flange corresponding to a certain angular zone about the axis of crankshaft 4.

Each of flanges 5 and 6 comprises a balancing mass 18, 19 which is formed by a solid metal piece and a fairing respectively 20 and 21 made from metal sheet, so as to have a cylindrical shape and form a disk for closing the crankcase-pump 5 on one of its lateral sides, inside casing 1. The fairing may be replaced by an added piece of low density.

The bevelled recesses 16 and 17 are machined in the solid portion of the corresponding flange forming the balancing mass 18 or 19. It is however possible to envisage other embodiments in which fairings 20 and 21 have a profiled shape so as to replace the machined bevelled portions 16 and 17 for forming cut-outs in the lateral surface of the flanges 6 and 7 for causing the inner volume of the crankcase-pumps to communicate with one or more apertures opening outside the casings.

In the embodiment shown in FIGS. 1 and 2, the wall of casing 1 comprises two apertures 24, 25 opening towards the inside of the crankcase-pump 5 each in a port passing through a fitting 26, 27 in the form of a ring portion housed inside the wall of casing 1 of the engine. Fittings 26 and 27 have C shaped cross sections which can be seen particularly in FIG. 2 for closing the ports passing through the fittings 26 and 27 and isolating the internal volume of crankcase-pump 5 from apertures 24 and 25, when the lateral portion of flanges 6 and 7 not comprising the bevelled portions 16 and 17 is placed opposite the apertures of the fittings 26 and 27.

On the other hand, as can be seen in FIG. 2, when the bevelled portions 16 and 17 forming the lateral cut-outs of the flanges 6 and 7 are opposite the ports of fittings 26 and 27 and the apertures 24 and 25 of wall 1, the inner volume of the crankcase-pump 5 is placed in communication with apertures 24 and 25 and via them with a duct 30 connected outside the wall of casing 1 to apertures 24 and 25 by a widened end portion.

During operation of the engine, flanges 6 and 7 integral with the crankshaft 4 are caused to rotate about the axis of rotation of the crankshaft so that cut-outs 16 and 17 situated on their lateral surface are positioned for certain phases of the operating cycle of the engine opposite the fittings 26 and 27 and apertures 24 and 25 so as to cause the inner volume of the crankcase-pump 5 to be placed in communication with duct 30.

Referring to FIGS. 3, 4, 5 and 6, the operation of an engine according to the invention will now be described whose flanges 6 and 7 defining laterally the crankcase-pump of the cylinder have peripheral cut-outs whose shape and dimensions are such that they allow the pneumatic injection control in another cylinder of the engine.

In FIGS. 3, 4, 5 and 6 and also in FIGS. 1 and 2, the corresponding elements bear the same references.

However, the elements of the cylinder shown in the right-hand part of FIGS. 3, 4, 5 and 6 comprise corresponding references with the exponent ′ (prime).

Injection is produced by connecting channel 30′ of the second cylinder, which is able to be placed in communication with the inner volume of the crankcase-pump 5′ of this second cylinder, during rotation of flanges such as 6′, with the pressurized carburetted air injection duct 14 of the first cylinder, via a connecting duct.

The lateral flanges such as 6′ of the crankcase-pump 5′ of the second cylinder comprise a cut-out such as 16′ having a certain circumferential extension and a position on the periphery of flange 6′, as a function of the arrangement of the connecting rod 3, such that this cut-out 16′ places the inner volume of crankcase-pump 5′ in communication with duct 30′ and the carburetted mixture injection duct 14, at well defined times of the operating cycle of the engine.

The direction of rotation of crankshaft 4 and of flanges 6 and 6′ have been shown by arrows 31 and 31′.

In FIG. 3, the piston 2 of the left-hand cylinder or first cylinder is in its lowest position, after expansion of the combustion gases in the chamber of the cylinder. Piston 2′ of the right-hand cylinder or second cylinder begins its downward stroke, under the effect of the combustion and of the expansion of the gases in the second cylinder. Flange 6′ of the corresponding crankcase-pump 5′ rotates so as to place recess 16′ opposite duct 30′.

Figure 4:
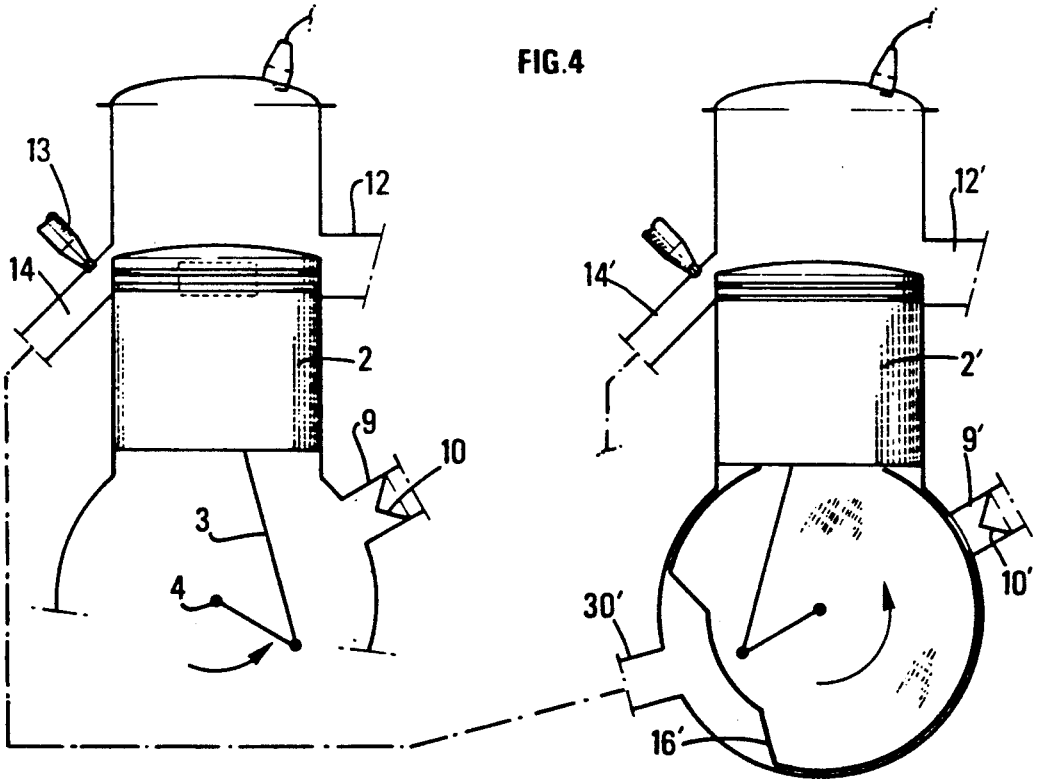

In the next phase shown in FIG. 4, piston 2 begins to rise inside the chamber of the first cylinder and opening 16′ has come opposite the duct′ 30′ of the second crankcase-pump 5′. The piston 2′ of the second cylinder is close to its bottom-most position, so that the air sucked into the crankcase-pump 5′ via nozzle 9′ and the valve is highly compressed. This pressurized air is driven into duct 14 in which it is mixed with pulverized fuel coming from injector 13. The pressurized air and pulverized fuel mixture is injected into the chamber of the first cylinder which has previously been emptied of the combustion gases which it contained and filled with fresh air from the crankcase-pump 5 via openings such as 11.

According to the invention, the means for controlling the injection of carburetted air into the cylinder is therefore formed by the flange or flanges such as 6′ of the crankcase-pump 5′ of the second cylinder on the periphery of which recesses such as 16′ are machined the position of which provides injection of the carburetted mixture into the cylinder at the desired moment of the operating cycle of the engine.

Figure 5:
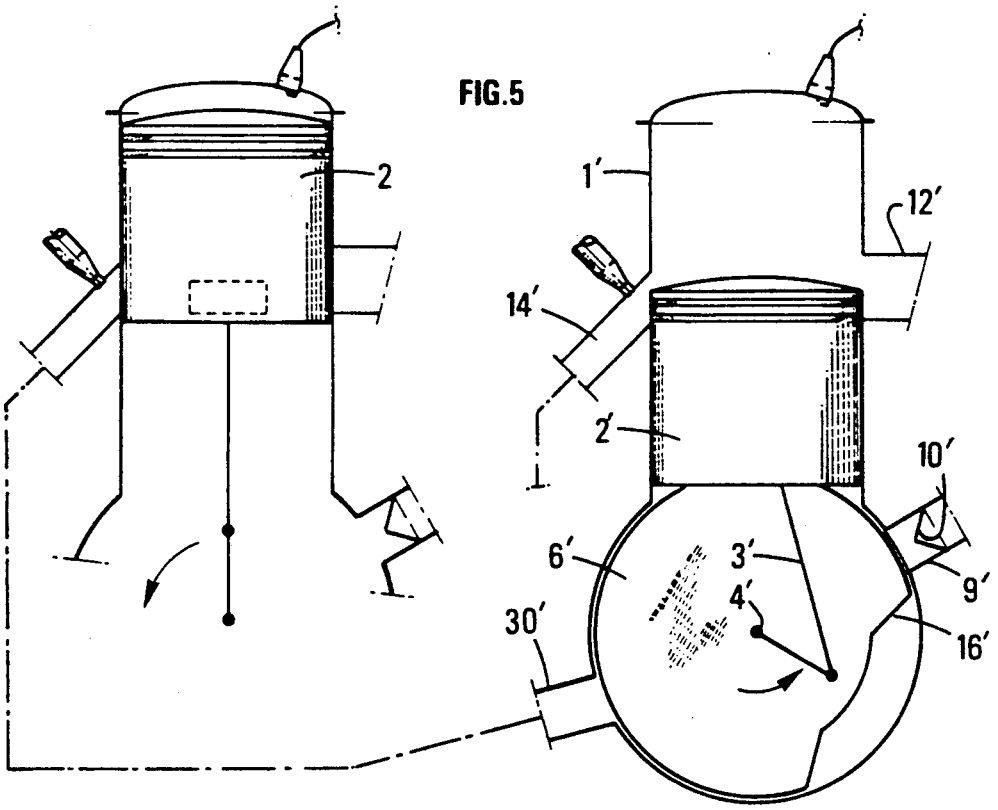

In FIG. 5, a subsequent phase of the operating cycle of the engine has been shown, the piston 2 of the first cylinder having moved upwards so as to compress the fresh air and carburetted air mixture previously injected into the cylinder. Simultaneously, cut-out 16′ has moved, so as to be outside the zone where is located the duct 30′ connected to the crankcase-pump 5′. The fuel injection duct remains under pressure to the extent that the inner volume of the crankcase-pump 5′ is under pressure at the time when cut-out 16′ has left the peripheral zone of the crankcase-pump in which duct 30′ is situated. Piston 2′ has begun to move upwards so as to scavenge and fill with fresh air the second cylinder in which a carburetted mixture may be introduced through duct 14′ connected to the crankcase-pump of a cylinder of the engine defined by lateral flanges having cut-outs such as flange 6′.

In the embodiment shown in FIGS. 3, 4, 5 and 6, the cylinder 1 is fed with a carburetted mixture from the crankcase-pump of a cylinder 1′ whose operating cycle is delayed by 120°, in so far as rotation of the crankshaft is concerned, with respect to the cylinder in which the injection takes place. Similarly, injection into duct 14′ may be effected and controlled from the crankcase-pump of the cylinder whose operating cycle is delayed by 120° with respect to the second cylinder 1′.

Figure 6:
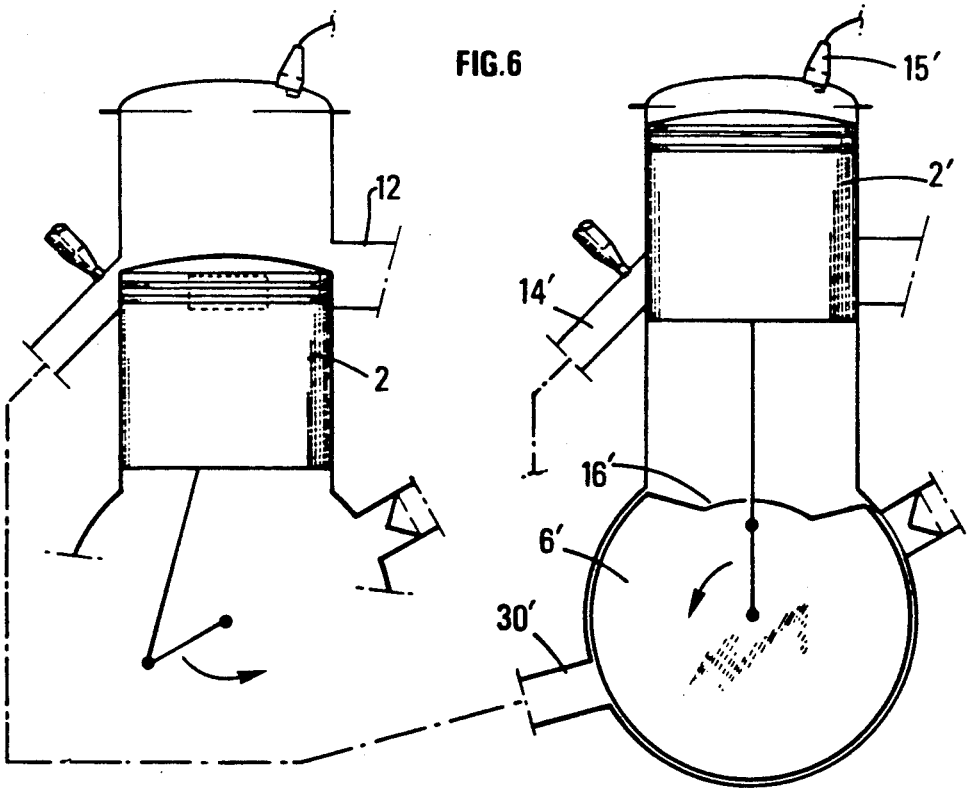

In FIG. 6, a phase has been shown corresponding to the end of the downward movement of piston 2 inside the first cylinder, under the effect of the combustion and expansion of the gases previously compressed in the phase shown in FIG. 5 and whose ignition is caused by sparking plug 15.

The cut-out 16′ of flange 6′ of the crankcase-pump of the second cylinder is then in its top position, in the extension of the chamber of the second cylinder. Piston 2′ is in its top position and compresses the gases formed by the fresh air and carburetted air mixture. Ignition of the carburetted mixture by the sparking plug 15′ results in the downward movement of piston 2′ and rotation of flange 6′ so as to cause cut-out 16 to rotate and come back to its position, corresponding to the phase shown in FIG. 3.

It is obvious that operation of the engine according to the invention, in so far as the supply of the crankcase-pumps with atmospheric air via nozzles 9 and 9′ of valves 10 and 10′ is concerned, is identical to the operation of conventional type two-stroke engines.

Similarly, the supply of fresh air to the cylinders and discharge of the burnt gases take place in a way equivalent to what happens in prior art engines.

Figure 7:
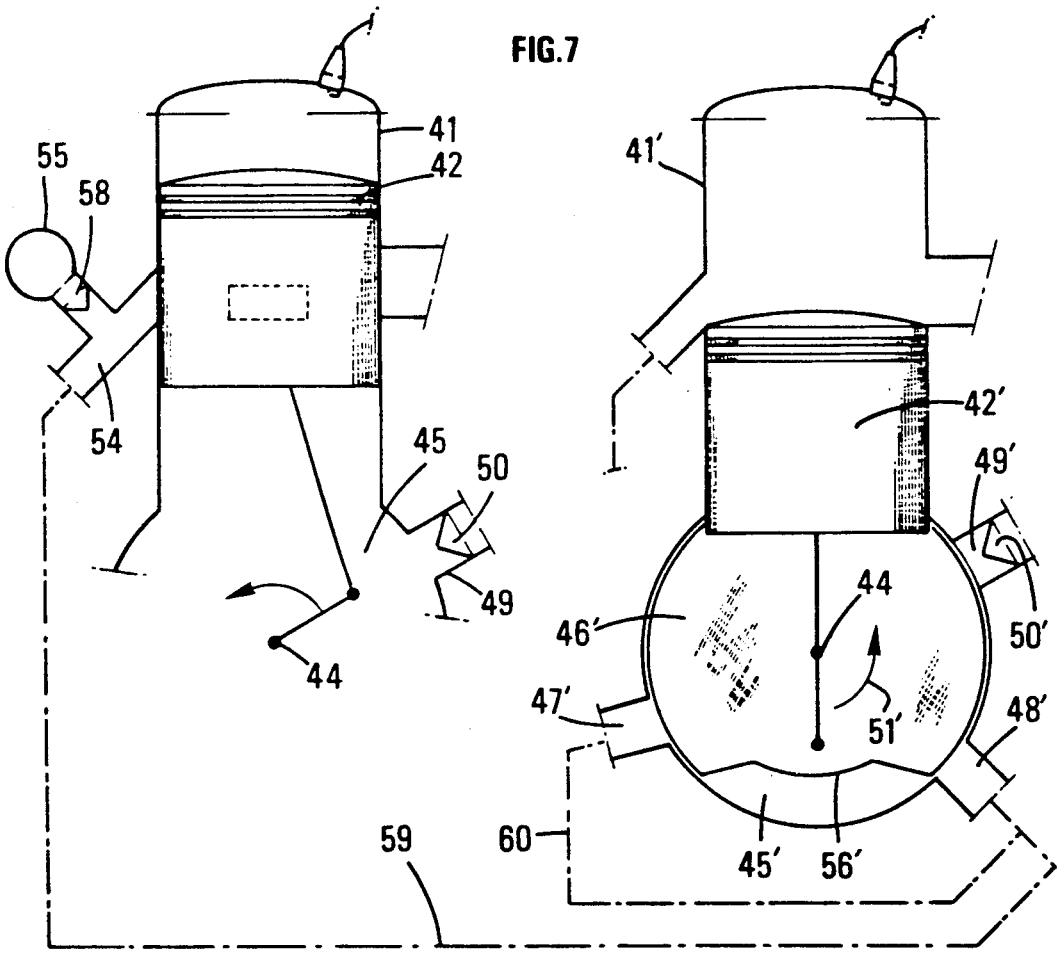
FIG. 7 is a schematic view of two cylinders of a two-stroke engine according to a second embodiment of the invention.

In FIG. 7, a first variant of an engine according to the invention has been shown comprising a first cylinder whose casing 41 defines a chamber in which a piston 42 moves, and a crankcase-pump 45 whose inner volume communicates with the lower portion of the chamber in which piston 42 moves. The engine comprises a second cylinder whose casing 41′ defines a chamber in which a piston 42′ moves and a crankcase-pump 45 communicating with the lower part of the chamber and defined laterally by flanges such as 46′ fixed to the crankshaft 4 of the engine so as to rotate inside the crankcase-pump 45′, in the direction of arrow 51′.

The crankcase-pumps of the cylinders comprise, in a way known per se, a nozzle 49 and a valve 50 (49′ and 50′ for the second cylinder) for supplying the corresponding crankcase-pump 45 or 45′ with atmospheric air.

Flange 46′ of the crankcase-pump 45′ of the second cylinder comprises a cut-out 56′ which may be formed, similarly to the cut-outs 16 and 17 shown in FIGS. 1 and 2, by machining or bevelling the peripheral surface of flange 46′ which is in the form of a disk or cylinder of small height.

The crankcase-pump 45′ in addition comprises two ducts 47′ and 48′ disposed similarly to duct 30 shown in FIG. 2 so as to be placed in communication with the inner volume of crankcase-pump 45′, at certain angular positions of flange 46′ and of cut-out 56′.

The first cylinder comprises a fuel injection duct 54 opening through the wall of casing 41 into the chamber of the cylinder itself and on which is branched a carburetter 55 having a valve 58 for isolating carburetter 55 from, or placing it in communication with, the carburetted air injection duct 54.

The carburetted air injection duct 54 is connected via connecting ducts 59 and 60, both to ducts 47' and 48' which can be placed in communication with the inner volume of the crankcase-pump 45', during certain phases of the operation of the engine.

A little before the phase shown in FIG. 7, the air contained in crankcase-pump 45 is under a high pressure, the piston 42' going towards its bottom position.

The cut-out 56' of flange 46' comes opposite duct 47' so that the pressurized air is sent into duct 54 and causes injection of fuel previously introduced into duct 54 by the carburetter 55.

Conversely, when piston 42' comes close to its top position, when the pressure in the crankcase-pump 45 is low, the cut-out 56' of flange 46' comes opposite duct 48' so as to create a depression in duct 59 and thereby in duct 54, which causes valve 58 to open and the introduction into duct 54 of fuel coming from carburetter 55. The depression caused in duct 54 by the passage of cut-out 56' at the level of duct 48' for a time t causes fuel to be introduced into duct 54.

It would also be possible to produce the depression in duct 54 through a cut-out in one of the lateral flanges of the crankcase-pump 45' and the injection of pressurized air for controlling and introducing fuel into the cylinder, by a cut-out in the second flange of the crankcase-pump 45', the cut-outs of the flanges of the crankcase-pump 45' cooperating with ducts placed in angular positions similar to those of ducts 47' and 48'.

Figure 8:
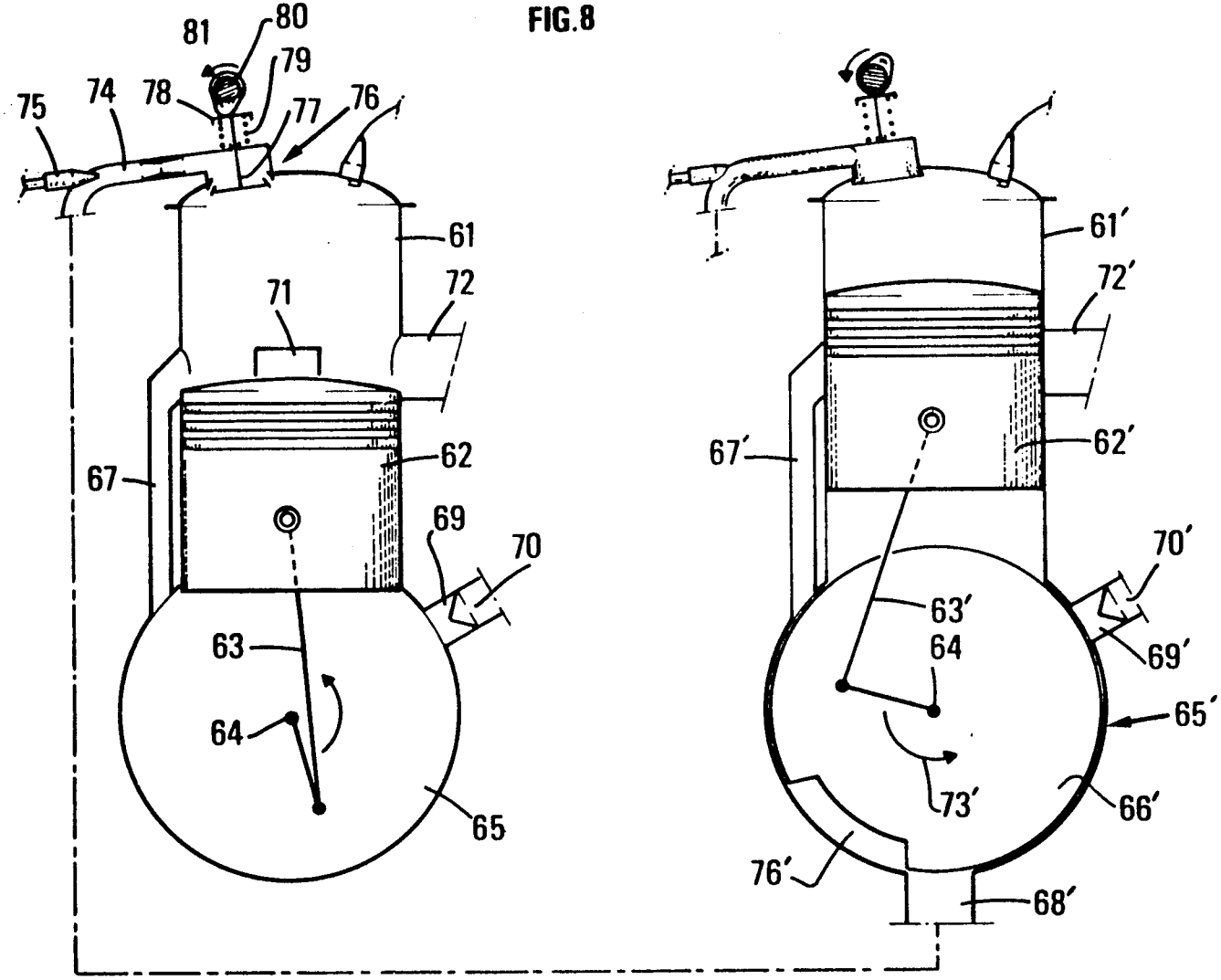
FIG. 8 is a schematic view of the two cylinders of a two-stroke engine according to a third embodiment of the invention and in which the injection control means into the cylinders comprise valves controlled by cams.

In FIG. 8, two cylinders have been shown of a two-stroke engine in which control of injection of the carburetted mixture into a cylinder of the engine may be provided either by placing a cut-out in a lateral flange of the crankcase-pump of another cylinder in coincidence with an opening in the wall of this crankcase-pump, or by a cam controlled valve, or else by these two means simultaneously.

Similarly, injection may be stopped in the case of the device shown in FIG. 8, either by the first means, i.e. a cut-out formed in the lateral surface of the flange of the crankcase-pump cooperating with an opening, or by a cam controlled valve, or by these two means simultaneously.

FIG. 8 shows schematically two cylinders of a two-stroke engine according to a second embodiment of the invention.

The two cylinders comprise casings 61 and 61' defining in their upper part a combustion chamber in which a piston 62 (or 62') moves.

The lower part of the chamber of the cylinder communicates with a crankcase-pump 65 (or 65'), the crankcase-pumps of the cylinders of the engine being traversed, in their axial direction, by the crankshaft 64 of the engine connected via connecting rods respectively 63 and 63' to pistons 62 and 62'.

The crankcase-pumps 65 and 65' comprise an atmospheric air intake nozzle 69 (or 69') in which is placed a valve 70 (or 70').

Furthermore, the crankcase-pumps 65 and 65' are connected to the chamber of the corresponding cylinder via ducts such as 67 and 67' opening into the cylinder through lateral openings such as opening 71.

Each of the cylinders also comprises, in a position slightly offset with respect to the fresh air intake openings such as 71, burnt gas exhaust ducts 72 (or 72').

The inner volume of the crankcase-pump 65' is defined laterally by flanges such as 66' fixed to crankshaft 64 for causing these flanges to rotate in the direction of arrow 73. One at least of the flanges 66' in the form of a disk or flattened cylinder comprises a lateral cut-out such as 76'. Furthermore, the wall of crankcase-pump 65 comprises an opening through which opens a duct 68 whose position with respect to flange 66' allows the inner volume of casing 65' to be placed in communication with duct 68, when the cut-out 76' of flange 66' comes into coincidence with the opening in crankcase-pump 65 into which duct 68 opens, during rotation of the crankshaft 64 and of flange 66' in the direction of arrow 73.

The duct 68 opening into the crankcase-pump 65' is connected by a pipe to an injection duct 74 into which opens an injector 75 for pulverizing fuel at given times, the injection duct 74 itself being connected via an intake device 76 to the upper part of the chamber of the first cylinder defined by the cylinder head of the engine.

The intake device 76 is formed by a chamber into which duct 74 opens and which is in communication with the inner volume of the combustion chamber of the first cylinder, via an opening which may be closed by a valve 77 whose shank is fast with a bearing surface 78 at its end situated opposite the element closing the opening placing the intake device 76 in communication with the chamber of the cylinder.

A return spring 79 is inserted between the bearing surface 78 and the external wall of the intake device 76.

A cam 80 fixed to a camshaft rotating in the direction shown by arrow 81 is also in contact with the bearing surface 78 of valve 77 so as to cause opening of this valve 77 at a given time during the operating cycle of the engine.

Figure 8A:
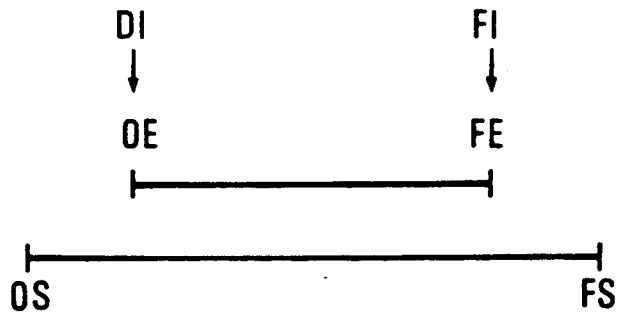
FIGS. 8A, 8B, 8C, 8D and 8E are diagrams corresponding to different types of operation of the engine shown in FIG. 8, in so far as control of the beginning and end of injection of the carburetted mixture into a cylinder are concerned.
Figure 8B:
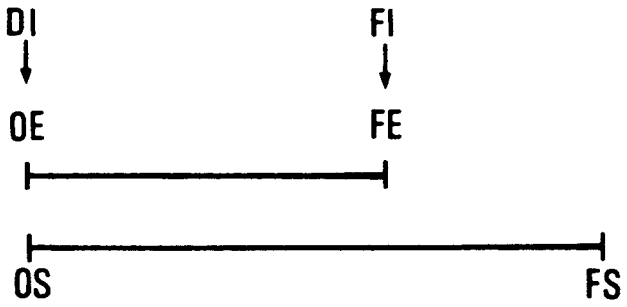

In FIGS. 8A and 8B there have been shown, in the form of straight line segments, the time intervals during which the opening of duct 68 giving into the crankcase-pump 65' is in concordance with the cut-out 76', the injection duct 74 the first cylinder being then in communication with the inner volume of the crankcase-pump 65' of the second cylinder and the time intervals during which valve 77 of the intake device 76 is open.

In FIGS. 8A to 8E, at the ends of the different straight line segments which represent different time intervals, indications have been given whose significance is the following :

DI: beginning of injection,
FI: end of injection,
OE: opening of cut-out 68,
FE: closure of recess 68,
OS: opening of valve 77,
FS: closure of valve 77.

In the case of FIG. 8A, opening of valve 77 precedes opening of the cut-out placing duct 68 in communication with the crankcase-pump 65' and closure of the valve is subsequent to closure of the cut-out of duct 68.

In this case, the beginning of injection is controlled by opening of the cut-out of the housing into which duct 68 opens and the end of injection is controlled by closure of this recess.

In the case of FIG. 8B, opening of the recess and opening of the valve are simultaneous and correspond to the beginning of injection.

On the other hand, closure of the valve is subsequent to closure of the recess and the end of injection is controlled by closure of the recess.

Figure 8C:
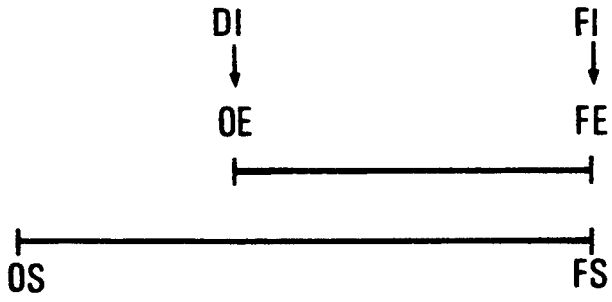

In the case of FIG. 8C, opening of the valve 77 precedes opening of the recess, and closure of the recess and of the valve are simultaneous.

In this case, the beginning of injection is controlled by opening of the recess and the end of injection by simultaneous closure of the recess and the valve.

Figure 8D:
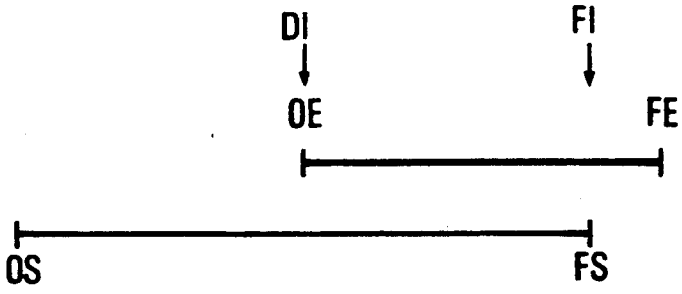

In the case of FIG. 8D, opening of the valve precedes opening of the recess and closure of the recess is subsequent to closure of the valve.

In this case, the beginning of injection is controlled by opening of the recess and end of injection by closure of the valve.

Figure 8E:
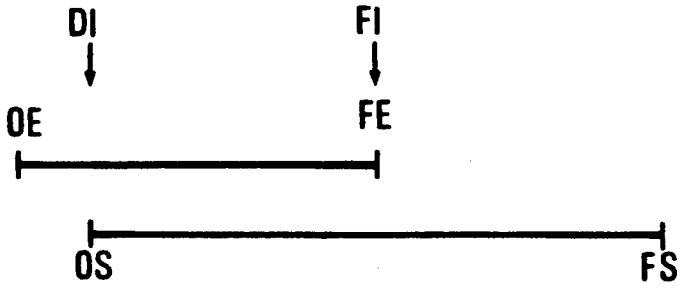

In the case of FIG. 8E, opening of the recess precedes opening of the valve and closure of the valve is subsequent to closure of the recess.

In this case, beginning of injection is controlled by opening of the valve and end of injection by closure of the recess.

Thus it can be seen that the device is very flexible and, depending on the amplitude of cut-out 76' in flange 66' of the second cylinder and depending on the design and adjustment of cam 81, it is possible to control the beginning and end of injection of carburetted air in the first cylinder by means which may be chosen so as to obtain the highest possible precision and optimum operation.

In particular, the combination of the injection control means described and shown in FIG. 8 ensures satisfactory operation with much less severe conditions in so far as design and adjustment of the cams and cut-outs are concerned, to the extent that one or other of the two control means may be used for determining the time corresponding to the beginning or to the end of injection into the cylinder.

Figure 9:
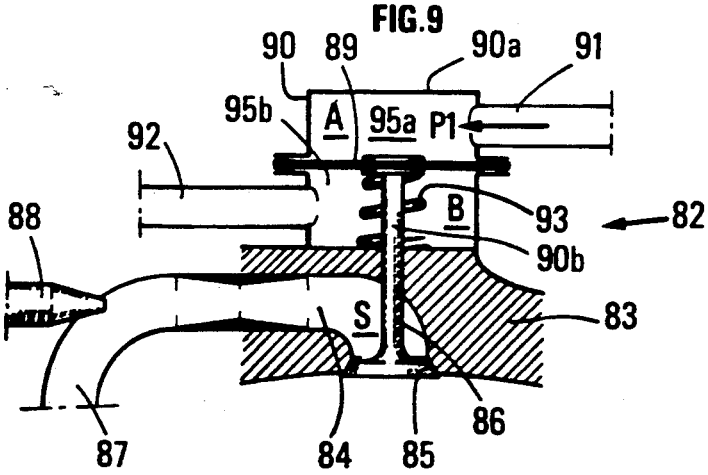
FIG. 9 is a sectional view of an automatic assisted valve forming a means for controlling injection into a cylinder of a two-stroke engine according to the invention.

In FIG. 9, a device has been shown for controlling injection into a cylinder of a two-stroke engine designated generally by the reference 82.

Figure 15:
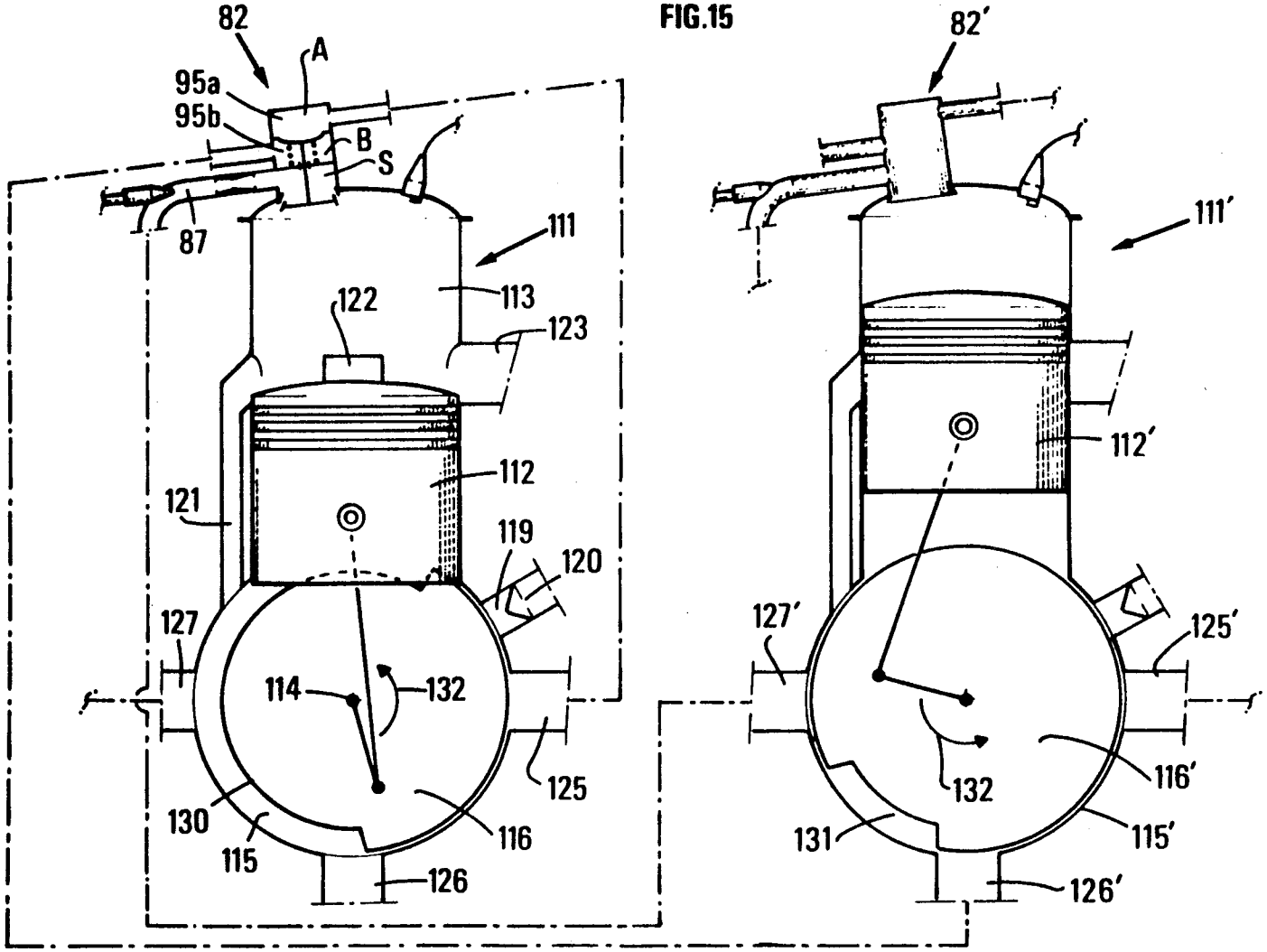
FIGS. 15 and 16 are schematic views of two cylinders of a two-stroke engine according to the invention using an automatic assisted valve as shown in FIG. 11, during two successive phases of the operating cycle of the engine.
Figure 16:
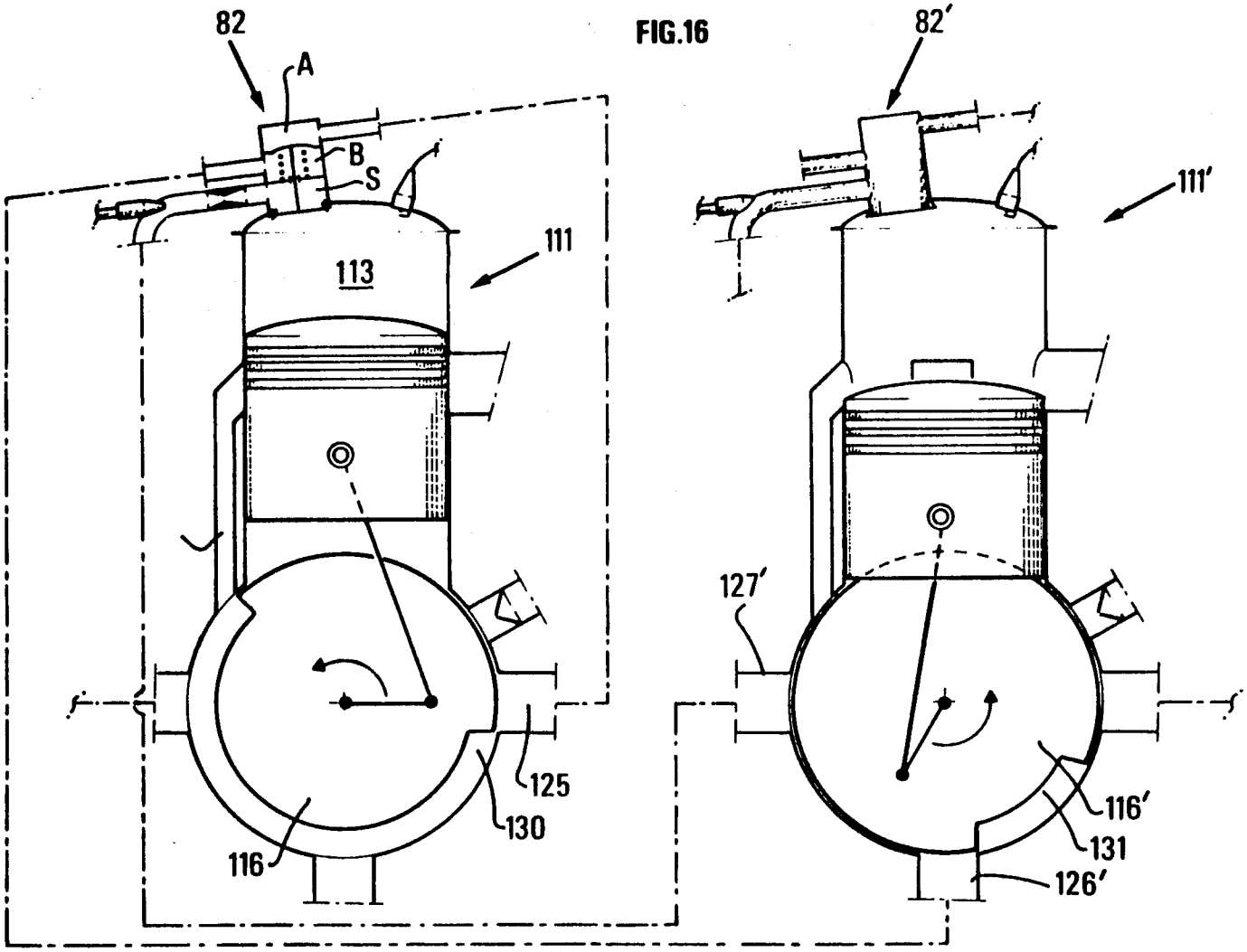

Such an injection device of the automatic assisted valve type may be associated with each of the cylinders of a two-stroke engine, such as shown in FIGS. 15 and 16.

In FIGS. 15 and 16, it can be seen that the automatic assisted valve injection device 82 (or 82') is fixed to the cylinder head of the engine at the level of the corresponding cylinder.

As can be seen in FIG. 9 as well as in FIGS. 11 and 13 which show automatic assisted valve devices identical as to their structure but different from the functional point of view, as will be explained hereafter, the injection device 82 comprises an injection channel 84 machined in cylinder head 83 and opening, through an opening 85, into the inner volume of the cylinder. Channel 84 is connected to a duct 87 into which the end of a fuel injector 88 opens.

The valve 86 for closing the end of channel 84 opening into the cylinder comprises a head coming to bear, in the closed position of the valve as shown in the figures, in opening 85 forming a valve seat. The shank of valve 86 is connected at its end to a flexible membrane 89 fixed along the whole of its periphery and sealingly between two portions of the wall of a casing 90 of the injection means 82.

Preferably, casing 90 is formed of an upper hollow half casing **90*a* and a lower half casing 90*b* joined together and at the periphery of membrane 89 via external flanges forming casing 90** assembly flanges.

The upper portion **90*a* of casing 90 comprises a duct 91 opening into its inner volume and the lower portion 90*b* of casing 90 which is fixed sealingly on the cylinder head 83 above the opening 85 of the channel 84, comprises a duct 92** opening into its inner volume.

A return spring 93 is inserted between the flexible membrane 89 or the end of the rod of valve 86 and the surface of cylinder head 83.

An assisted control valve injection device such as shown in FIG. 9 allows the opening and closing of the valve to be controlled, which determine the beginning and end of injection into the cylinder, by adjusting the differential pressure between chambers **95*a* and 95*b* defined in casing 90 by membrane 89. For that, ducts 91 and 92 may be connected to regulated pressure gas supply devices for causing opening or closing of valve 86 by the differential pressure in chambers 95*a* and 95*b*, as well as by the differential pressure between chamber 84** and the cylinder.

According to the invention, in the case of a two-stroke engine with several cylinders and pneumatic injection, the control pressure in at least one of chambers **95*a* and 95*b*** is produced by placing this chamber in communication with the inner volume of the crankcase-pump of one of the cylinders of the engine.

Figure 10:
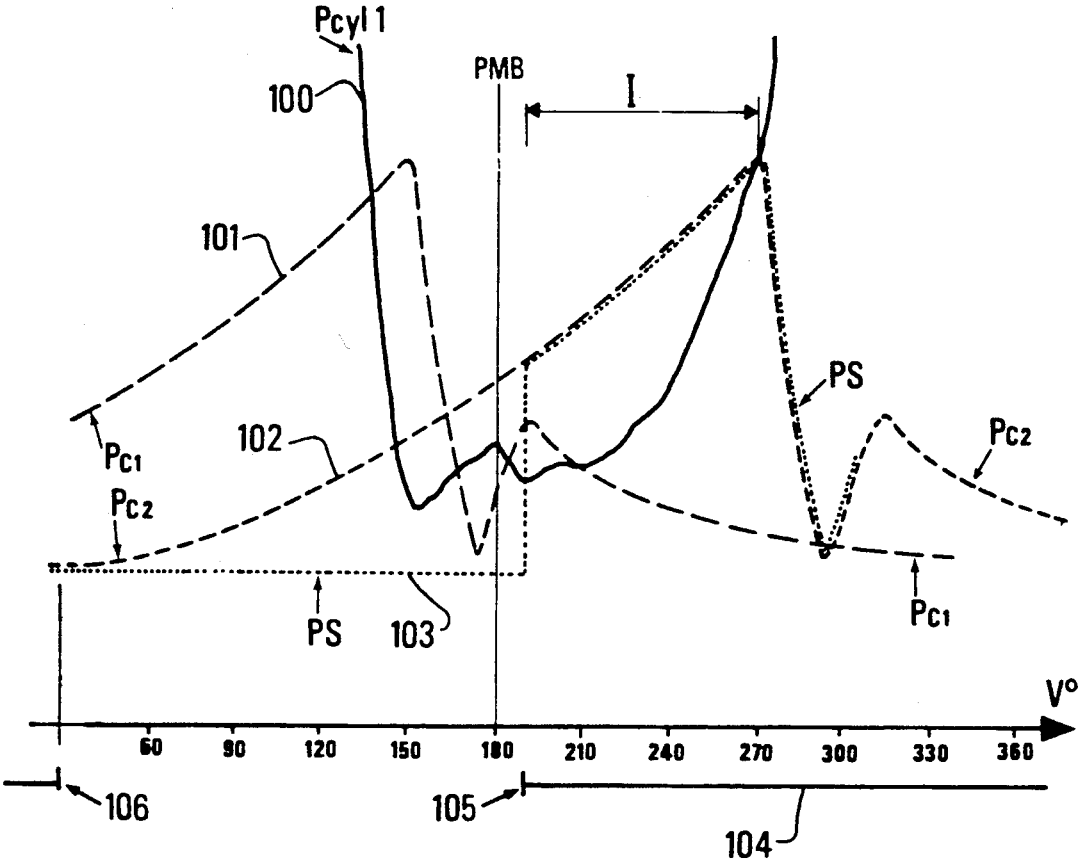
FIG. 10 is a diagram showing the variations of the pressure in a cylinder and in the associated crankcase-pump of an engine according to the invention, as well as in the crankcase-pump of a second cylinder of the engine, as a function of the angle of rotation of the crankshaft.

In FIG. 10, there has been shown as a function of the angle of rotation of the crankshaft of a three cylinder two-stroke engine, the pressure variations in the chamber of the first cylinder of the engine (continuous line curve 100), the pressure variations PC1 in the crankcase-pump of the first cylinder (broken line curve 101), the pressure variations PC2 in the crankcase-pump of a second cylinder of the engine whose operating cycle is shifted by 120° of crankshaft rotation with respect to the first cylinder (chain dotted line 102) and the control pressure P1 for the automatic assisted valve ensuring injection into the first cylinder (dotted line curve 103).

The control pressure of the valve is applied in chamber **95*a*, this chamber being connected via duct 91 to a duct which may be placed in communication with or on the contrary isolated from the inner volume of the crankcase-pump of the second cylinder, using one or more flanges fixed on the crankshaft of the engine at the level of the crankcase-pump and having a peripheral cut-out, for example such as shown in FIGS. 1 and 2**.

The peripheral cut-out in the lateral flange or flanges of the crankcase-pump is such that communication with the crankcase-pump is interrupted between 40 and 190°, considering the rotation of the crankshaft and so that, on the contrary, this communication is provided during the rest of the cycle, this part of the cycle during which communication with the crankcase-pump of the second cylinder is provided being shown schematically by the two-part straight line segment 104 shown in FIG. 10. The origin of segment 104 is situated at a point 105 corresponding to a rotation of 190° of the crankshaft and the end of segment 104 at a point 106 corresponding to a rotation of 40° of the crankshaft.

For the injection of carburetted air into the first cylinder at the desired moment, duct 87 connected to channel 84 at one of its ends is connected, at its other end, to the duct opening into the crankcase-pump of the second cylinder which can be placed in communication with or isolated from the inner volume of this crankcase-pump by one or two flanges comprising a lateral cut-out.

As can be seen in FIG. 10, between 40° and 190° of crankshaft rotation, the control pressure P1 in chamber **95*a* (curve 103) is kept at a constant and low level corresponding to the minimum pressure in the crankcase-pump of the second cylinder during the cycle. This pressure is applied in chamber 95*a* and in duct 87** to the extent that the opening of the duct emerging in the crankcase-pump has been closed by the flange or flanges of this crankcase-pump at the moment when the pressure in the crankcase-pump was at its minimum value.

At the moment when the initial part of the cut-out provided in the flange or flanges of the crankcase-pump of the second cylinder reaches the level of the opening in the crankcase-pump into which the duct opens, the pressure PC2 prevailing in the crankcase-pump is transmitted to chamber 95*a* through duct 91, the control pressure P1 then passes from its constant and low value to the value PC2 in the crankcase-pump of the second cylinder at a time corresponding to the 190° rotation of the crankshaft (see FIG. 10).

The pressure in the crankcase-pump PC2 is then greater than the pressure in the first cylinder (curve 100).

Chamber 95*b* of the injection device being vented through duct 92, the pressure PC2 formed in chamber 95*a* participates in opening the valve 86 and injecting carburetted air into the chamber of the first cylinder. With duct 87 also connected to the pipe opening into the crankcase-pump of the second cylinder and being fed with air at a pressure PC2, fuel is injected by injector 88 into the pressurized air stream fed into the cylinder.

The control pressure P1 in chamber 95*a* is kept at the value PC2 for the whole duration of crankshaft rotation between points 105 and 106 defining the segment 104 corresponding to the time interval during which the pipe opening into the crankcase-pump of the second cylinder is open.

The pressure PC2 remains greater than the pressure in the chamber of the first cylinder (curve 100) until the moment when this pressure in the crankcase-pump reaches its maximum, the corresponding piston being in i's bottom position inside the chamber of the second cylinder. From this position corresponding substantially to a 270° rotation of the crankshaft, the pressure PC2 decreases very rapidly and becomes less than the pressure in the first cylinder. Curves 102 and 103 representative of the pressure PC2 and so of the control pressure P1 intersect curve 100 and pass below this curve. Valve 86 closes again, which corresponds to the end of the injection period I shown in FIG. 10. This injection period begins at 190° crankshaft (opening of the duct opening in to the crankcase-pump of the second cylinder) and ends at the moment when the pressure PC2 becomes less than the pressure in the chamber of the first cylinder.

According to the invention, by using one or more flanges rotating inside the crankcase-pump and comprising a peripheral cut-out, carburetted air injection is obtained which is perfectly regulated inside the cylinder. However, in the embodiment shown in FIGS. 9 and 10, only the beginning of injection is assisted and controlled by the flange or flanges rotating in the crankcase-pump of the second cylinder.

Figure 12:
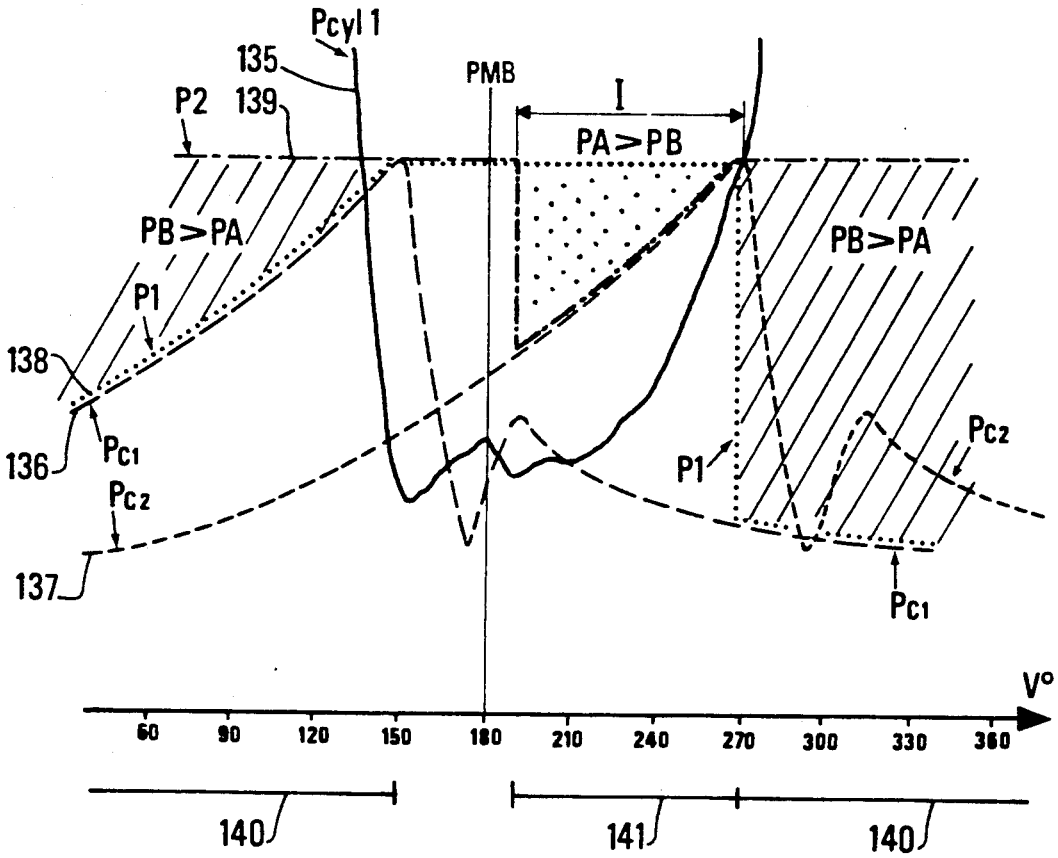
FIG. 12 is a diagram showing the different control pressures of the automatic assisted valve shown in FIG. 11, as a function of the angle of rotation of the crankshaft.
Figure 11:
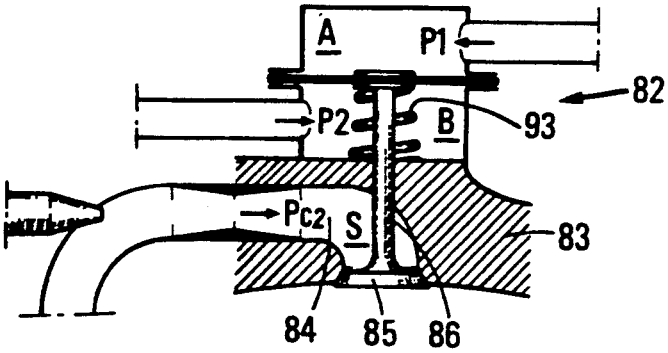
FIG. 11 is a sectional view of a first embodiment of an automatic assisted valve forming an injection control means for a two-stroke engine according to the invention.

Referring to FIGS. 11 and 12 as well as to FIGS. 15 and 16, an embodiment of an automatic assisted valve injection device will now be described in which assistance of the valve is provided not only at the beginning but also at the end of injection, by rotation of the flange in the crankcase-pump of the second cylinder.

Generally, the injection device 82 shown in FIG. 11 comprises the same elements (designated by the same references) as the automatic assisted valve injection device shown in FIG. 9. However, chambers 95*a* and 95*b* each receive a control pressure (respectively P1 and P2) whereas in the case of the device shown in FIG. 9, chamber 95*b* was vented through duct 92.

Device 82 shown in FIG. 11 and also visible in FIGS. 15 and 16 is fixed, like the device shown in FIG. 9 to the upper part of the cylinder head 83 of the corresponding cylinder in which is machined the injection channel 84 which opens through an opening 85 into the chamber of the cylinder.

Referring to FIGS. 15 and 16 it can be seen that the assisted valve injection device 82 is fixed to the upper part of the cylinder head of a first cylinder 111 comprising a combustion chamber 113 in which moves a piston 112 communicating at its lower part with a crankcase-pump 115 defined laterally by flanges such as 116 fixed to the crankshaft 114 passing axially through the crankcase-pump 115.

The crankcase-pump 115 comprises, conventionally, an air intake nozzle 119 in which a valve 120 is placed.

The fresh air introduced into housing 115 and compressed by piston 112 is injected into the combustion chamber 113 of cylinder 111 through transfer ducts such as 121 opening into the cylinder chamber through openings 122. The burnt gases are discharged from chamber 113 through a duct 123.

The second cylinder 111' which is shown in the right-hand part of FIGS. 15 and 16 has a structure identical to cylinder 111 and has similar elements which have been designated by the same reference to which the exponent ' has been added.

On the crankcase-pump 115 are further fixed ducts 125, 126 and 127 comprising an opening emerging into the inner volume of crankcase-pump 115. Ducts 125 and 126 are placed so that their opening into the crankcase-pump is opposite one of the flanges defining the crankcase-pump 115, such as flange 116.

On the other hand, duct 127 emerges through its opening into the inner volume of the crankcase-pump 115, between the flanges defining this crankcase-pump laterally.

The crankcase-pump 115' of the second cylinder 111' has three ducts 125', 126' and 127' opening into the inner volume of crankcase-pump 115' and disposed in the same way as ducts 125, 126 and 127 respectively.

To provide assisted pneumatic injection not only at the beginning of injection but also at the end of injection, as it will be explained with reference to FIG. 12, chamber 95*a* of the injection device 82 of cylinder 111 is connected by a connecting duct to pipe 125. Chamber 95*b* is connected to pipe 126' of the crankcase-pump 115' of the second cylinder 111' and the injection duct 87 of device 82 opening into the injection channel 84 of the cylinder head of cylinder 111 to the duct 127' of the crankcase-pump 115'.

In addition, the flange 116 of the crankcase-pump 115 comprises a recess 130 of large angular amplitude at its periphery. Flange 116' of the crankcase-pump 115' has a recess 131 whose angular amplitude is substantially less than that of recess 130.

The direction of rotation of the crankshaft 114 has also been shown in FIGS. 15 and 16 by arrows 132.

FIG. 15 show the position of the elements of both cylinders 111 and 111' at the beginning of injection and FIG. 16 shows the position of these elements at the end of injection, in so far as cylinder 111 is concerned.

Reference will now be made to FIG. 12 to explain the operation of the injection device shown in FIG. 11 and in FIGS. 15 and 16.

The second cylinder 111' has an operating cycle retarded by 120° of crankshaft rotation with respect to the operating cycle of cylinder 111.

In FIG. 12, the pressure in the combustion chamber 113 of the first cylinder 111 has been shown by a continuous line curve 135 and the pressures PC1 and PC2 in the crankcase-pumps 115 and 115' have been shown by broken line curves 136 and 137, respectively as a function of the angle of rotation of the crankshaft.

The control pressure P1 in chamber 95*a* of the injection device 82 has also been shown in FIG. 12 by a dotted line curve 138 and the control pressure P2 in chamber 95*b* of the injection device 82 has been shown by a chain-dotted line curve 139.

The time or rotation interval of the crankshaft has also been shown, in the form of a two-part straight line segment 140, during which pipe 125 of crankcase-pump 115 is in communication with the inner volume of the crankcase-pump, recess 130 during this interval concording with the opening of duct 125 opening into the crankcase-pump. During this time interval, the pressure PC1 of the air in the crankcase-pump 115 is transmitted to chamber 95*a* of the injection device 82, through the corresponding connecting duct.

There has also been shown in the form of a straight line segment 141 the time or rotation interval of the crankshaft during which the duct 126' of the crankcase-pump 115' is placed in communication with the inner volume of the crankcase-pump, recess 131 of flange 116' coinciding with the opening 126' emerging in the inner volume of the crankcase-pump 115'. During this time interval, chamber 95*b* of the injection device 82 is subjected to the pressure PC2 of the air contained in crankcase-pump 115'.

The injection channel 84 of device 82 is constantly in communication with the inner volume of housing 115'.

The angular amplitude of recess 130 and the arrangement of flange 116 with respect to crankshaft 114 are such that opening of duct 125 via recess 130 occurs between 270° and 150° of crankshaft rotation during the following cycle (segment 140).

At the time of closure of duct 125 (for 150° crankshaft), the pressure PC1 in the crankcase-pump 115 is close to its maximum, piston 112 being in its low position. The pressure of the air P1 in chamber 95*a* (upper part of curve 138) is therefore maintained at a high level between 150° and 270° crankshaft.

The recess 131 and the position of flange 116' are such that closure of duct 126' occurs for a value of the angle of rotation of the crankshaft of 270° .

With the cycle of the cylinder 111' retarded by 120° with respect to the cycle of cylinder 111, the pressure PC2 in the crankcase-pump 115' is at its maximum at the time of closure of duct 126'. The pressure P2 in chamber 95*b* of device 82 is therefore maintained at a constant and high value equal to the maximum value of pressure PC1, for 270° crankshaft, up to the opening of duct 126' via the recess 131 for 190° crankshaft of the following cycle (upper part of curve 139).

From 190° to 270° crankshaft, the pressure in chamber 95*b* corresponds to the pressure PC2 (interval represented by the segment 141).

The result is that the curves 138 and 139 representative of P1 and P2 respectively comprise parts merging with the curves 136 and 137 respectively, the horizontal segments corresponding to the upper pressure level in the crankcase-pumps and the vertical junction portions corresponding to the pressure drop in the control chambers 95*a* and 95*b* at the time of opening of ducts 125 and 126' respectively.

As can be seen in FIG. 12, in which the injection interval I is shown, the beginning of injection is controlled by the opening of duct 126' of the crankcase-pump 115' at 90° crankshaft, by causing recess 131 to coincide with the opening of duct 126', the pressure in chamber 95*b* then passing to the value PC2 of the pressure in the crankcase-pump 115'. This pressure is then appreciably less than the maximum pressure in the crankcase-pump, piston 112' being in an intermediate position between top dead center and bottom dead center, as can be seen in FIG. 15. The pressure in chamber 95*a* is maintained at the maximum value of the pressure PC1 in housing 115, the duct 125 being closed at the beginning of injection, as shown in FIG. 15.

The result is that the pressure PA in chamber 95*a* is very much greater than the pressure PB in chamber 95*b*, which assists opening of valve 86 by the differential pressure at the beginning of injection.

The injection of carburetted air through channel 84 is ensured because channel 84 is connected to the inner volume of the crankcase-pump 115' and because the pressure PS in the injection channel 84 (curve 137) is constantly equal to pressure PC2 in casing 115'.

It should be noted that before the beginning of injection, the pressures PA and PB in chambers 95*a* and 95*b* are identical, valve 86 is then held in a closed position by spring 93, the pressure PS in the injection duct 84 then being slightly greater than the pressure in cylinder 111 (curve 137 above curve 135).

During injection, the pressure difference in chambers 95*a* and 95*b*, i.e. the difference between pressures PA and PB or P1 and P2 decreases constantly to become zero for 270° crankshaft, at the moment when duct 125 opens and duct 126' closes.

The end of injection is controlled by opening duct 125 which produces a pressure drop P1 from its maximum value to a low value. The pressure PB then becomes very much greater than the pressure PA which causes rapid and assisted opening of the valve 86 at 270° crankshaft.

In FIG. 12, a first zone has been shown in which the pressure PA is greater than the pressure PB, this zone corresponding to injection and a second zone (in two parts) has been shown in which the pressure PB is greater than the pressure PA, valve 86 being held in the closed position by differential pressure.

Between these two zones, the pressures PA and PB are identical and, as mentioned, valve 86 is held in the closed position by spring 93 and by the high cylinder pressure because of the compression of the gases.

In FIG. 16, the cylinders 111 and 111' have been shown at the end of injection, i.e. at the moment when duct 125 is opened through recess 130. This phase corresponds also to closure of duct 126'.

It is obvious that ducts 126 and 127 of the first cylinder 111 are connected respectively to the chamber 95*a* of an injection device similar to device 82 or 82' of a cylinder in advance by 120° crankshaft with respect to cylinder 111 and to the injection channel of this cylinder respectively.

Duct 126 comprises an opening emerging into the crankcase-pump 115, opposite the second flange of this crankcase-pump (not shown in FIGS. 15 and 16) comprising a recess having an appropriate amplitude and arrangement.

Figure 14:
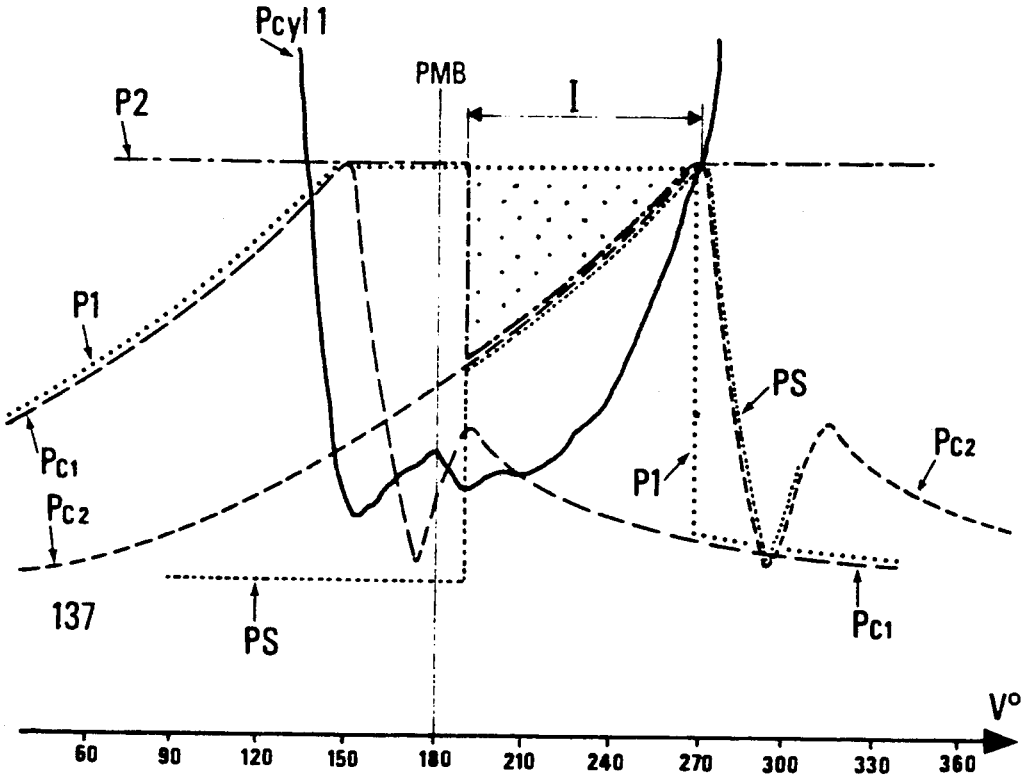
FIG. 14 is a diagram showing the control pressures of the automatic assisted valve shown in FIG. 13, as a function of the angle of rotation of the crankshaft.
Figure 13:
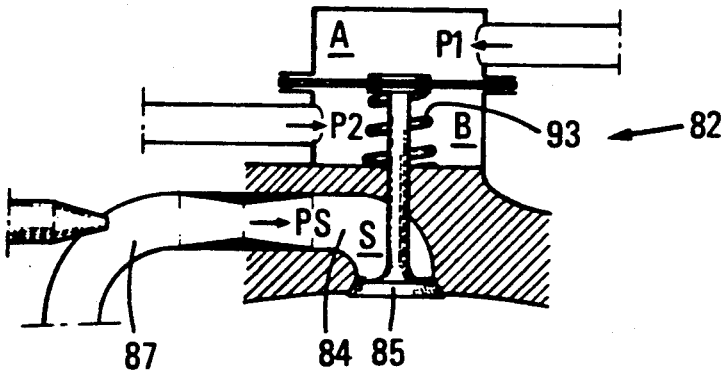
FIG. 13 is a sectional view of an automatic assisted valve in a second embodiment forming the means for injection into a cylinder of a two-stroke engine according to the invention.

In FIGS. 13 and 14, a variant of an injection device with a valve assisted on opening and closing has been shown.

The corresponding device is substantially identical to the device described with reference to FIGS. 11, 12, 15 and 16 and its operation is substantially identical.

However, as can be seen from curve 137' of FIG. 14 representing the pressure PS in the injection channel 84, this pressure PS is no longer constantly identical to the pressure PC2 in the crankcase-pump of a cylinder retarded by 120° crankshaft with respect to the cylinder in which injection takes place.

This pressure PS has variations identical to the control pressure P1 of the embodiment shown in FIG. 10 (curve 103), during the operating cycle of the engine.

The injection duct 87 and channel 84 are connected to the crankcase-pump of the cylinder retarded by 120° crankshaft with respect to the cylinder in which the injection takes place, via a duct situated at the level of a flange having a recess causing opening of the duct opening into the crankcase-pump between 190° and 40° crankshaft.

Between 40° and 190° crankshaft, the pressure PS is kept at a low value which corresponds to the pressure PC2 in the crankcase-pump of the second cylinder, at the time of closure of the duct connected to the injection duct 87. This extremely low pressure is generally less than the atmospheric pressure, so that this pressure contributes to holding the valve in the closed position before the beginning of injection, whereas the control pressures in chambers 95*a* and 95*b* are equal.

The opening of the duct of the second crankcase-pump connected to the injection duct 87 at 190° crankshaft, by placing a recess of a flange in coincidence with the opening of the duct of the crankcase-pump for supplying the injection duct 87 and channel 84 with air from the crankcase-pump at pressure PC2. Simultaneously, the pressure P1 drops and becomes very much less than the pressure P2, which causes opening of valve 86.

In all cases, the automatic assisted valve injection device makes it possible to obtain a perfectly controlled injection, at a perfectly determined time of the operating cycle of the cylinder of the engine.

It is obvious that the invention is not limited to the embodiments which have been described.

Any embodiment of the flanges mounted for rotation in the crankcase-pumps may be envisaged, these flanges possibly comprising recesses or cut-outs formed in the peripheral part of the flange, by machining or forming or by other processes.

In the case of using an automatic assisted valve injection device, the control pressure may be established in one at least of the chambers of the device by connecting this chamber to an opening in the crankshaft of a cylinder, retarded by 120° crankshaft with respect to the cylinder in which injection takes place, which opens at a point of the cylinder which is covered during the operating cycle by the skirt of the piston in which an opening is provided, as described in the French patent application to the INSTITUT FRANCAIS DU PETROLE no. 89/08855. This arrangement allows the pressure in the control chamber to be adjusted to a desirable value, during operation of the engine, without having to use a flange mounted for rotation in a crankcase-pump and comprising a cut-out on its peripheral edge.

In the case where injection is controlled both by a cut-out provided in a flange and by a valve (case of FIG. 8), it is possible to avoid the use of a cam for controlling the valve by using a spring having a moderate return force, the valve being then possibly controlled by the difference of pressure between the injection duct and the combustion chamber of the cylinder.

Finally, the invention may be applied advantageously, to the design of any multi-cylinder two-stroke engine in which pneumatic fuel injection is provided.

What is claimed is:

1. A two-stroke engine comprising at least a first cylinder in which a piston moves and a second cylinder one of the ends of which communicates with a crankcase-pump through which the crankshaft of the engine passes in an axial direction and comprising a means for air intake into the crankcase-pump, at least one connection duct between the crankcase-pump of the second cylinder and the combustion chamber of the first cylinder, means for feeding at least one of the connection ducts with fuel, injection control means for isolating the crankcase-pump of the second cylinder from or putting it in communication with the combustion chamber of the first cylinder and connection means between the mobile pistons in the first and second cylinders connected to the crankshafts, so that there exists an angular shift between the cycles of the first and second cylinders, wherein said injection control means comprise at least one substantially cylindrical flange fixed rigidly on the shaft of the crankshaft, inside the crankcase-pump of the second cylinder and having at least one recess in its peripheral portion so as to provide, via at least one of said ducts, intermittent communication between the combustion chamber of the first cylinder and the crankcase-pump of the second cylinder at predetermined times of the operating cycle, under the effect of the rotation of the crankshaft.

2. The engine as claimed in claim 1, wherein the recess of said flange is formed by a bevelled portion of the peripheral portion of the flange intended to cooperate with an opening passing through the wall of the crankcase-pump and opening into a conduit fixed to the outside of the crankcase-pump.

3. The engine as claimed in claim 2, wherein sealing segments with through-holes are disposed in the wall of the crankcase-pump, at the level of said through-holes in this wall, so as to cooperate with the peripheral portion of the flange for isolating the conduit from or placing it in communication with the inner volume of the crankcase-pump.

4. The engine as claimed in any one of claims 1, 2 and 3, wherein said injection control means further comprise a valve for opening and closing a communication passage between an injection duct connected to the crankcase-pump of the second cylinder by one of said connecting ducts and the combustion chamber of the first cylinder.

5. The engine as claimed in claim 4, wherein said valve is controlled by a cam and a return spring.

6. The engine as claimed in claim 4, wherein said valve is an an automatic assisted valve whose shank is connected to a flexible membrane sealingly separating two chambers, one at least of which is connected by a duct to a closable opening communicating with the inner volume of one of the crankcase-pumps of the first or second cylinders.

7. The engine as claimed in claim 6, wherein one of the chambers of the injection control means is connected to the crankcase-pump of the second cylinder and the other chamber is vented to the atmosphere.

8. The engine as claimed in claim 6, wherein one of the chambers of said injection control means is connected to the crankcase-pump of the first cylinder and the second chamber is connected to the crankcase-pump of the second cylinder.

9. The engine as claimed in claim 7 wherein said carburetted air supply duct is placed permanently in communication with the crankcase-pump of the second cylinder through a non closable opening.

10. The engine as claimed in claim 1, wherein the connecting duct between the chamber of the first cylinder and the crankcase-pump of the second cylinder is connected to the crankcase-pump via at least two openings which can be closed by said flange comprising a recess, so as to cause, via one of the closable openings, a depression in the duct and an injection of pressurized air and fuel into the duct via the other closable opening.

* * * * *